US012577851B2

(12) United States Patent
Arabskyy et al.

(10) Patent No.: US 12,577,851 B2
(45) Date of Patent: Mar. 17, 2026

(54) WELLBORE FLOW CONTROL VALVE AND METHOD

(71) Applicant: ExxonMobil Technology and Engineering Company, Spring, TX (US)

(72) Inventors: Serhiy Arabskyy, Leduc (CA); Andrew Barabash, Edmonton (CA)

(73) Assignee: ExxonMobil Technology and Engineering Company, Spring, TX (US)

( * ) Notice: Subject to any disclaimer, the term of this patent is extended or adjusted under 35 U.S.C. 154(b) by 106 days.

(21) Appl. No.: 18/552,638

(22) PCT Filed: Apr. 20, 2022

(86) PCT No.: PCT/CA2022/050597

§ 371 (c)(1),
(2) Date: Sep. 26, 2023

(87) PCT Pub. No.: WO2022/226630

PCT Pub. Date: Nov. 3, 2022

(65) Prior Publication Data

US 2024/0167363 A1 May 23, 2024

Related U.S. Application Data

(60) Provisional application No. 63/180,750, filed on Apr. 28, 2021.

(51) Int. Cl.
*E21B 34/14* (2006.01)
*E21B 34/06* (2006.01)

(52) U.S. Cl.
CPC ..... *E21B 34/142* (2020.05); *E21B 34/063* (2013.01); *E21B 34/14* (2013.01); *E21B 2200/08* (2020.05)

(58) Field of Classification Search
CPC .... E21B 2200/08; E21B 34/063; E21B 34/14; E21B 34/142
See application file for complete search history.

(56) References Cited

U.S. PATENT DOCUMENTS 6,155,350 A 12/2000 Melenyzer
8,215,411 B2 7/2012 Flores et al.
(Continued)

FOREIGN PATENT DOCUMENTS

CA 2994290 11/2017
CA 2994290 A1 * 5/2019 ..... E21B 34/063
(Continued)

OTHER PUBLICATIONS

International Search Report and Written Opinion for PCT/CA2022/050597, filed Apr. 20, 2022, mailed Jul. 13, 2022 (10 pages).
(Continued)

*Primary Examiner* — Daniel P Stephenson
(74) *Attorney, Agent, or Firm* — Troutman Pepper Locke LLP

(57) ABSTRACT

Assemblies and methods are provided for a sleeve assembly for controlling communication with a downhole formation having a sleeve housing with one or more flow ports slidably retaining a sleeve, the sleeve having one or more treatment ports. The sleeve is configured to slide between an uphole closed position, in which the one or more flow ports are blocked by the sleeve, and a downhole open position in
(Continued)

which the one or more flow ports are at least partially aligned with the one or more treatment ports. The one or more treatment ports may have inset members.

22 Claims, 16 Drawing Sheets

(56) References Cited

U.S. PATENT DOCUMENTS

| | | | | |
|---|---|---|---|---|
| 8,245,788 | B2 | 8/2012 | Garcia et al. | |
| 8,714,272 | B2 | 5/2014 | Garcia et al. | |
| 9,297,241 | B2 | 3/2016 | Arabskyy | |
| 9,587,464 | B2 | 3/2017 | Jani | |
| 9,840,890 | B2 | 12/2017 | Nordheimer | |
| 9,840,892 | B2 | 12/2017 | Nordheimer | |
| 10,077,628 | B2 | 9/2018 | Arabskyy | |
| 10,113,394 | B2 * | 10/2018 | Hekelaar | E21B 34/142 |
| 10,577,890 | B2 | 3/2020 | Nordheimer | |
| 2007/0017679 | A1 * | 1/2007 | Wolf | E21B 23/006 166/174 |
| 2009/0044949 | A1 * | 2/2009 | King | E21B 33/1208 166/373 |
| 2013/0168087 | A1 * | 7/2013 | Linklater | E21B 33/128 166/120 |
| 2014/0027117 | A1 * | 1/2014 | Hekelaar | E21B 31/107 166/297 |
| 2015/0000920 | A1 * | 1/2015 | Harris | E21B 23/004 166/305.1 |
| 2015/0226031 | A1 * | 8/2015 | Hekelaar | E21B 34/063 166/374 |
| 2019/0128097 | A1 | 5/2019 | Arabskyy | |
| 2019/0136666 | A1 * | 5/2019 | Kent | E21B 34/142 |
| 2020/0102807 | A1 | 4/2020 | Kennedy | |
| 2020/0182018 | A1 | 6/2020 | Nordheimer | |
| 2020/0362668 | A1 * | 11/2020 | Fripp | E21B 34/063 |
| 2021/0348478 | A1 | 11/2021 | Novelen et al. | |
| 2024/0167363 | A1 * | 5/2024 | Arabskyy | E21B 34/142 |

FOREIGN PATENT DOCUMENTS

| | | |
|---|---|---|
| EP | 2511470 | 9/2017 |
| WO | WO 2015/117221 | 8/2015 |
| WO | WO 2020/024057 | 2/2020 |

OTHER PUBLICATIONS

Search Report (United Arab Empirates) for Application No. P6002549/2023, mailed Aug. 1, 2024.

Office Action (United Arab Empirates) for Application No. P6002549/2023, mailed Aug. 1, 2024.

* cited by examiner

WELLBORE FLOW CONTROL VALVE AND METHOD

CROSS-REFERENCE TO RELATED APPLICATIONS

This application is a National Stage application of PCT/CA2022/050597, filed Apr. 20, 2022, which claims the benefit of U.S. Provisional application No. 63/180,750 filed on Apr. 28, 2021, the entire contents of which are incorporated herein by reference.

FIELD

Embodiments taught herein relate to apparatus and methods for use in wellbore completion operations and, more particularly, to downhole sleeve valves.

BACKGROUND

In staged wellbore completion operations, a formation is divided into multiple zones that are treated in isolation. Conventional sleeve assemblies are used to selectively establish communication between a bore of a tubular string, such as a casing string or completion string, extending along a wellbore and the wellbore. Each sleeve assembly comprises a tubular housing fit with a sleeve. The sleeve assemblies are typically spaced along the casing string and are configured to permit the flow of fluids through ports of the tubular housing when the sleeve is shifted axially to an open position to expose ports in the housing or to block the flow of fluids therethrough when the sleeve covers the ports in a closed position.

When zones do not need to be closed after opening, open-only sleeve assemblies may be used. These sleeve assembles are run-in-hole with the sleeves initially in a closed configuration, wherein ports in the housing of the sleeve assemblies that allow fluid communication from the production string to the wellbore are blocked by the sleeves. During treatment, the sleeves are shifted to an open configuration, wherein the ports in the housing are exposed. These sleeves are commonly ball-actuated, wherein a ball introduced into the casing string at surface engages a seat of the corresponding sleeve. The pressure in the casing bore can then be increased to shift the sleeve downhole, such as with downhole fluid pressure.

To provide the capability to open sleeve assemblies at particular zones of interest along the wellbore, the seats of the sleeves can be varied to correspond with the zones of interest. The sleeve assemblies can be arranged such that those having the smallest diameter seat are located at the lower portion of the well, and the seats of the sleeve assemblies increase in diameter toward surface. To actuate the sleeve controlling communication with the zone of interest, a ball having a size corresponding to the seat of the sleeve can be introduced. The ball proceeds downhole from surface and bypasses the larger seats of those sleeve assemblies uphole of the sleeve of interest, and is seated on the seat of the sleeve of interest. Pressure in the casing bore can then be increased to actuate the sleeve of interest to expose the ports thereof and establish communication with the zone of interest.

It is also known to provide multiple consecutive sleeve assemblies having equal sized seats to be actuated with the same ball. The seats of the sleeve assemblies can be configured to permit the ball to continue to travel therethrough after the sleeve has been actuated to the open position. The seat of the most downhole sleeve of the series can be configured to retain the ball thereon. In this manner, the series of sleeve assemblies can be opened such that a zone of interest can be treated through multiple sleeve assemblies at once.

Further, it is known to provide burst discs or plugs in the ports of the sleeve housings configured to rupture, shatter, or otherwise be removed at a predetermined threshold bore pressure so as to permit flow through the ports. In this manner, a series of sleeve assemblies can be actuated to the open position using casing bore pressure without loss of fluid pressure through the exposed ports of sleeve assemblies uphole. When the threshold bore pressure is reached, the burst discs of the sleeve assemblies of the series are ruptured, such that treatment fluid can then flow through the ports of the sleeve assemblies of the series substantially simultaneously.

U.S. Pat. No. 8,215,411 to Flores et al. ("Flores") discloses a cluster opening sleeve apparatus and method using ball-actuating shifting sleeves, wherein ports have insets with small orifices that produce a pressure differential to help shift the sleeves. Flores teaches that these insets are removed with a threshold bore pressure once the sleeves have shifted.

U.S. Pat. No. 9,297,241 to Arabskyy ("Arabskyy") discloses a fracturing tool and method using a sliding sleeve assembly with burst plugs installed in fluid ports to conceal the fluid ports prior to shifting. Said burst plugs are also shattered or removed by a requisite bore pressure after the sleeves have been shifted to the open position.

Flores and Arabskyy both teach the use of insets or plugs in the ports in the outer housing of the corresponding sleeve assemblies. As the insets are exposed to the irregular surface of the wellbore when the sleeve assemblies are run-in-hole with the casing string, they are susceptible to contamination or damage. Such damage can cause leakage of fluid from the casing bore into the wellbore, or failure of the insets before the predetermined pressure is reached. A failure of this type may be difficult to detect until operations have commenced and may render the casing string inoperable, requiring replacement of the entire casing string.

Additionally, to prevent or mitigate the buildup of debris (e.g. rocks or cement) in the sleeve housing ports and inset nozzles, a protective layer of cement inhibiting grease can be located in the ports with a thin membrane thereover to prevent said grease from being displaced. However, such covering is typically easily ruptured and said grease would similarly be exposed to the adverse conditions of the wellbore as the casing string is run-in-hole.

There is interest in the oil and gas industry for sleeve assemblies that provide more reliable protection to fluid treatment ports prior to opening thereof for treatment.

SUMMARY

The disclosure provides a sleeve assembly having a sleeve housing with flow ports and a shifting sleeve slidably retained therein and having corresponding treatment ports. When the sleeve assembly is in a closed configuration, the body of the sleeve blocks the flow ports and the treatment ports are misaligned with the flow ports. When the sleeve assembly is in an open configuration, the treatment ports of the sleeve align with the flow ports of the sleeve housing, allowing fluid communication to the formation. Correspondingly, when the sleeve assembly is in the closed configuration, the treatment ports are protected from and against fluid, debris, and rough surfaces in the wellbore by the body of the housing.

In the present disclosure, insets are placed in the treatment ports and are not exposed to the formation as the sleeve assembly is run-in-hole with the sleeve in the closed position, thus mitigating potential damage to the insets. In some embodiments where the inset is a burst disc, the burst discs are protected from wellbore pressure and potential inadvertent rupture/activation when the sleeve is in the closed configuration, as the inset is protected from the formation when the sleeve is in the closed configuration. In some embodiments wherein the inset is dissolvable, the insets are not exposed to water or other fluids in the wellbore prior to shifting the sleeve assembly to the open configuration.

In a broad aspect, a sleeve assembly for controlling communication with a downhole formation includes a sleeve housing, a sleeve and a seat. The sleeve housing has a housing bore and one or more flow ports. The sleeve is retained slidably in the housing bore and has a sleeve bore and one or more treatment ports. The sleeve is slidable from an uphole closed position, in which the one or more flow ports are blocked by the sleeve, to a downhole open position in which the one or more flow ports are at least partially aligned with the one or more treatment ports. The seat is disposed in the sleeve bore, configured to extend at least partially into the sleeve bore to receive an actuating member. The sleeve also has one or more inset members disposed in each of the one or more treatment ports.

In an embodiment, the inset members are burst discs of a frangible material for at least temporarily maintaining fluid pressure in the sleeve bore and configured to be removed once the fluid pressure reaches a threshold pressure.

In an embodiment, the inset members are at least partially dissolvable material.

In an embodiment, the inset members are non-dissolvable nozzles.

In an embodiment, the inset members are a dissolvable material surrounding the non-dissolvable nozzle and the inset member is removable from the treatment port when the dissolvable material dissolves.

In an embodiment, the sleeve defines one or more radial grooves in the exterior surface of the sleeve straddling the one or more treatment ports with sealing members positioned therein.

In an embodiment, the housing defines one or more radial grooves in the housing bore straddling the one or more flow ports and having sealing members positioned therein.

In an embodiment, the seat is actuable between a first condition wherein the seat retains an actuating member and a second condition wherein the seat is adapted to deform to allow the actuating member to pass through the sleeve bore.

In an embodiment, the seat is in the first condition when the sleeve is in the uphole closed position and in the second condition when the sleeve is in the downhole open position.

In an embodiment, the actuating member is one of a ball, a plug, or a dart.

In an embodiment, the sleeve is temporarily retained in the uphole closed position using a retainer.

In an embodiment, the retainer is a shear screw or retaining pin.

In an embodiment, the sleeve housing has an annular overhang defining an annular protection pocket configured to receive at least a portion of the sleeve when the sleeve is in the uphole closed position, such that the one or more inset members are located in the protection pocket.

In an embodiment, sealing members are positioned on one or both of the sleeve and sleeve housing to fluidly isolate the one or more inset members in the protection pocket when the sleeve is in the uphole closed position.

In a broad aspect, a method of treating a zone in a formation accessed with a completion string having one or more sleeve assemblies therealong includes introducing an actuating member into the completion string to engage a seat of a target sleeve assembly of the one or more sleeve assemblies, actuating the target sleeve assembly from an uphole closed position to a downhole open position with the actuating member engaged in the seat to at least partially align one or more treatment ports of a sleeve of the target sleeve assembly with one or more flow ports of the target sleeve assembly, increasing fluid pressure in the completion string to a threshold pressure to burst inset members disposed in the one or more treatment ports, and treating the formation through the aligned treatment ports and flow ports.

In an embodiment, the step of actuating the target sleeve assembly to the downhole open position further includes removing the one or more treatment ports of the sleeve from a protection pocket of the target sleeve assembly.

In a broad aspect, a method of treating a zone in a formation accessed with a completion string having one or more sleeve assemblies therealong includes introducing an actuating member into the completion string to engage a seat of a target sleeve assembly of the one or more sleeve assemblies, actuating the target sleeve assembly from an uphole closed position to a downhole open position with the actuating member engaged in the seat to at least partially align one or more inset nozzles in one or more treatment ports of a sleeve of the target sleeve assembly with one or more flow ports of the target sleeve assembly, and treating the formation through the inset nozzles of the aligned treatment ports and the flow ports.

In an embodiment, the inset nozzles are at least partially made of a dissolvable material, and the step of treating the formation further includes dissolving the dissolvable material, and producing fluid from the formation through the aligned treatment ports and flow ports once the dissolvable material has dissolved.

In an embodiment, the step of actuating the target sleeve assembly to the downhole open position further includes removing the one or more treatment ports of the sleeve from a protection pocket of the target sleeve assembly.

DETAILED DESCRIPTION

The present disclosure relates to sleeve assemblies located along wellbore casing extending through a subterranean formation for controlling fluid communication between a bore of said casing and select targeted zones, or zones of interest, of the formation. Said communication is established through one or more flow ports formed in a housing of the sleeve assemblies and corresponding treatment ports in a sleeve of the sleeve assembly when in an open position.

Ports that are exposed to the formation while the casing string is run-in-hole are susceptible to plugging by debris. It may also be desirable to prevent fluid flow through the ports even when the sleeve assembly has been actuated to the open position, and only permit fluid flow therethrough once a requisite threshold bore pressure has been reached. As a result, sleeve assemblies may include inset members within the ports that are broken, ruptured, or otherwise removed in response to the bore pressure reaching the predetermined level. However, these inset members themselves are exposed and are susceptible to damage when the casing string is run-in-hole. The present disclosure teaches an apparatus wherein inset members are protected when the casing string is run-in-hole.

Figure 1:
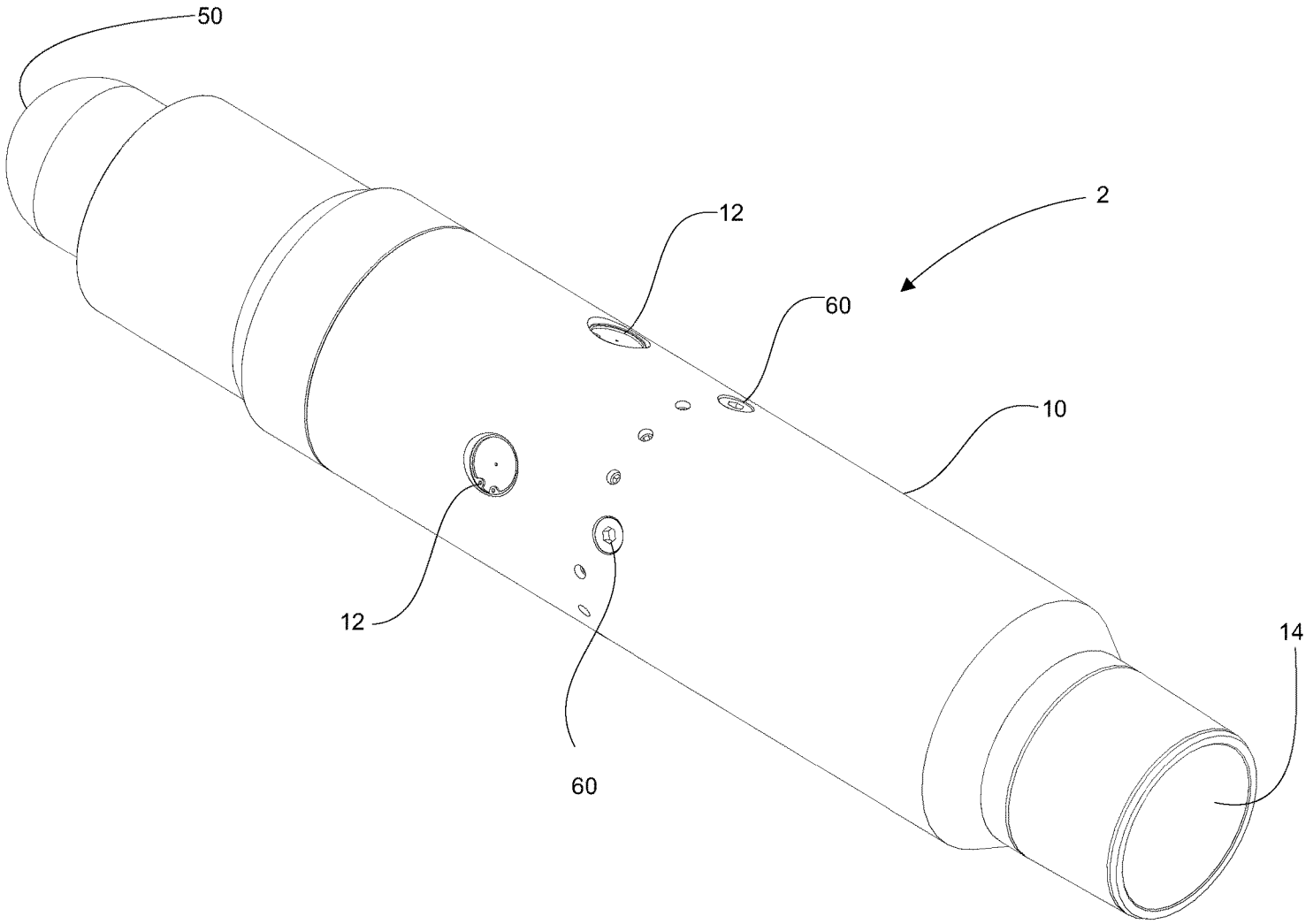
FIG. 1 is a perspective view of an embodiment of a sleeve assembly disclosed herein.
Figure 2:
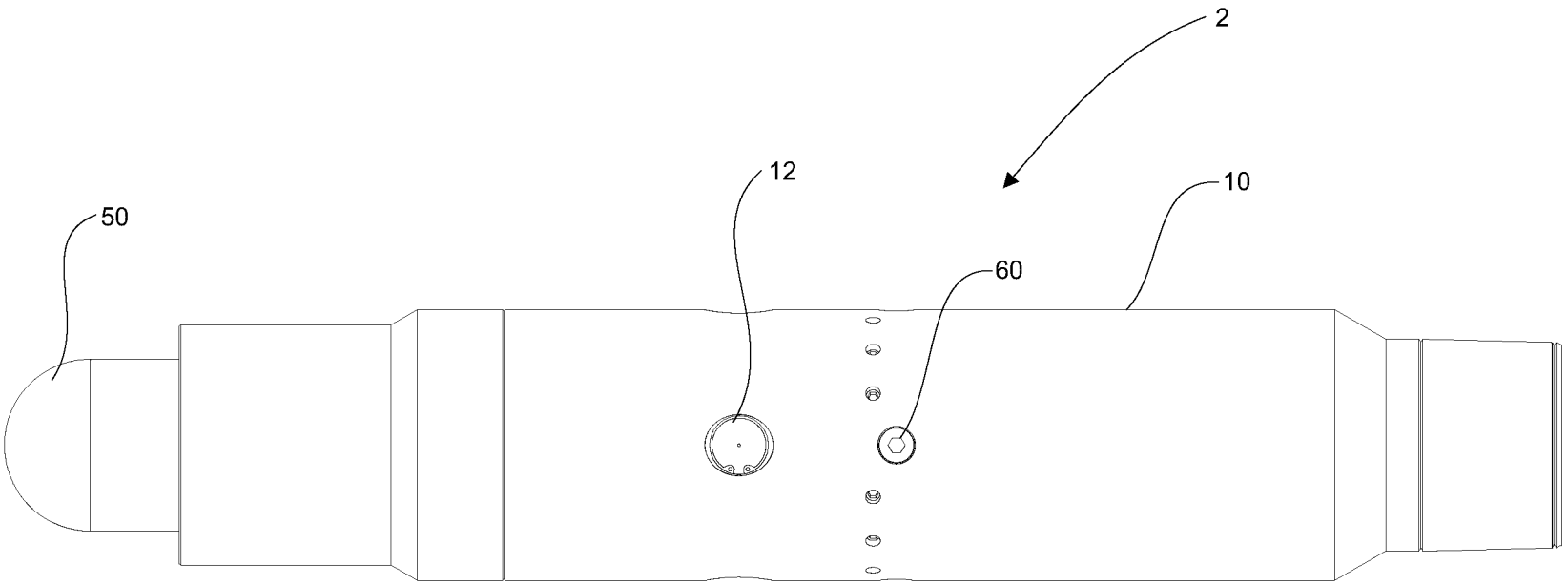
FIG. 2 is a side view of the sleeve assembly of FIG. 1.
Figure 3:
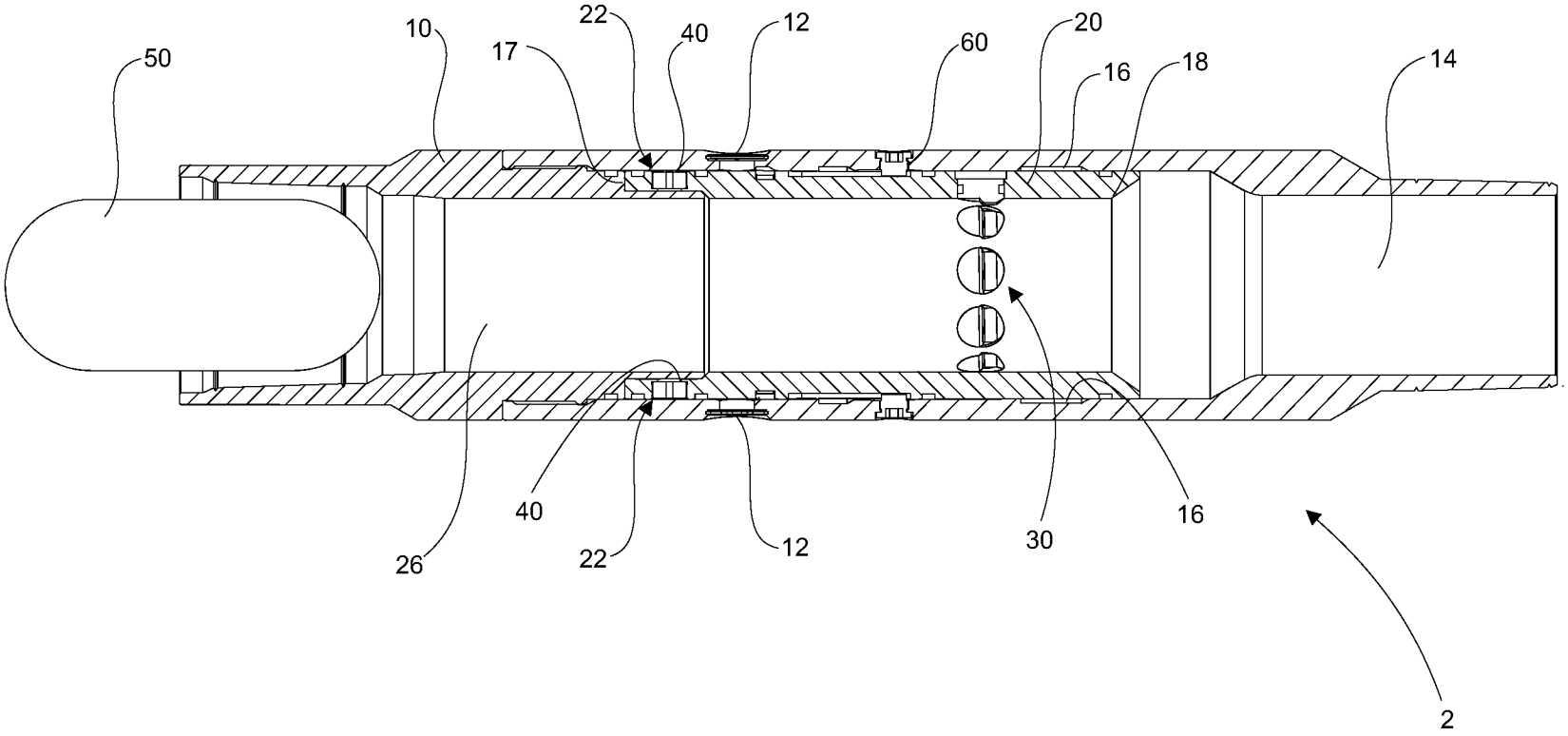
FIG. 3 is a side section view of the sleeve assembly of FIG. 1 in a closed configuration.
Figure 4:
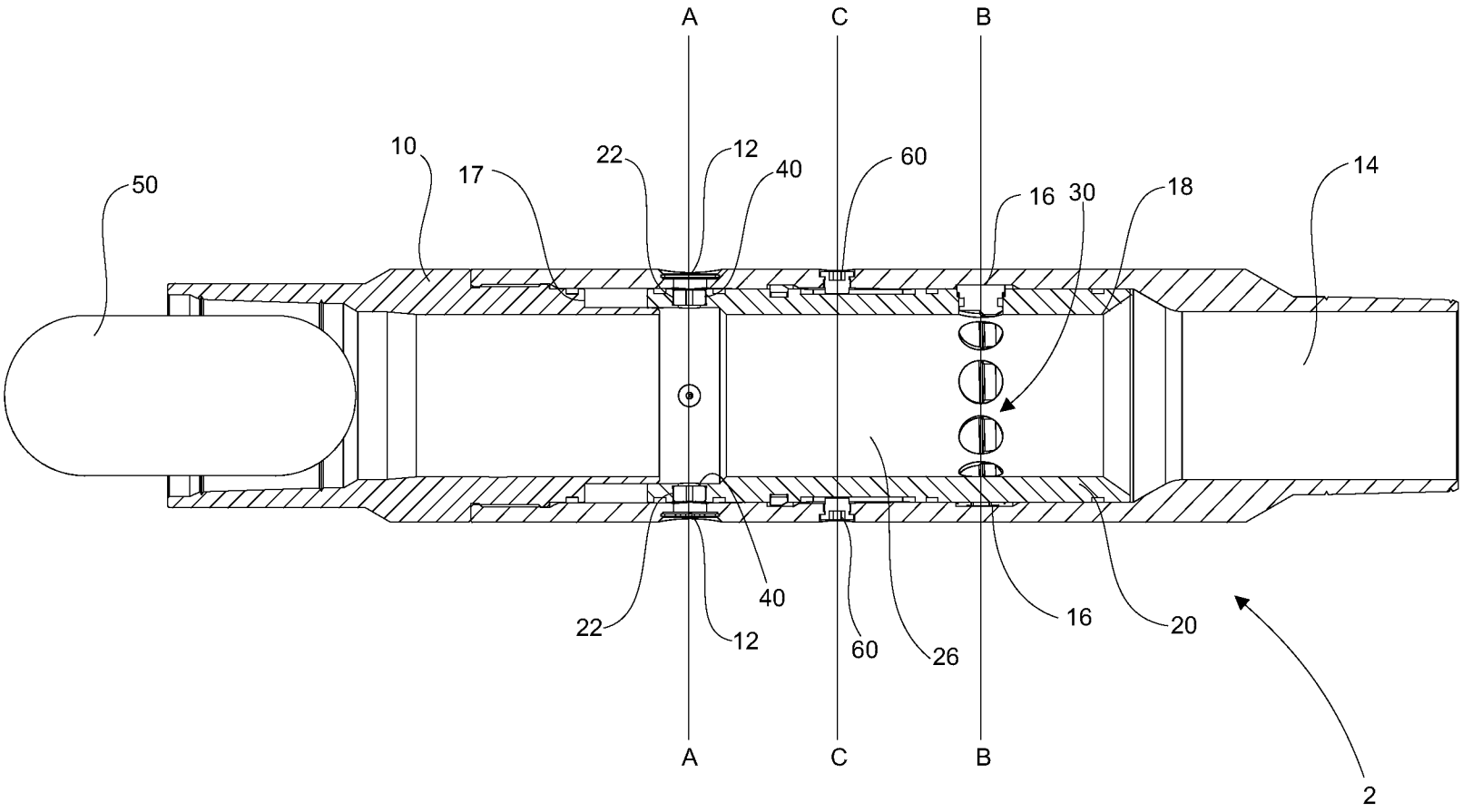
FIG. 4 is a side section view of the sleeve assembly of FIG. 1 in an open configuration.

Referring to FIGS. 1 and 2, an embodiment of a sleeve assembly 2 comprises a generally tubular sleeve housing 10 and a generally tubular sleeve 20. Referring to FIGS. 3 and 4, the sleeve housing 10 defines a housing bore 14 extending axially therethrough and one or more radial flow ports 12. The housing bore 14 is in communication with the bore of the casing string. The one or more flow ports 12 provide fluid communication between the housing bore 14 and the exterior of the housing 10. The housing bore 14 is designed to slidably retain the sleeve 20 therein, and permit it to actuate between at least between an uphole closed position and a downhole open position.

The sleeve 20 defines a sleeve bore 26 extending axially therethrough and one or more radial treatment ports 22. The one or more treatment ports 22 provide fluid communication between the sleeve bore 26 and an exterior of the sleeve 20. In some embodiments, the one or more treatment ports 22 correspond in size and position to the one or more flow ports 12, and are at least partially aligned therewith when the sleeve 20 is in the downhole open position.

In some embodiments, annular seals 27 can be provided in seal grooves 25 defined in an exterior surface of the sleeve 20 or in the housing bore 14 and straddling the flow ports 12 for fluidly sealing between the housing bore 14 and the sleeve 20 when the sleeve 20 is in the downhole open position such that in the downhole open position, the annular seals 27 assist in ensuring that fluid in the sleeve bore 26 flowing through the treatment ports 22 flow through flow ports 12 and not through the space between the housing bore 14 and the sleeve 20. Similarly, annular seals 27 can be provided in seal grooves 25 defined in the exterior surface of the sleeve 20 or in the housing bore 14 to straddle the flow ports 12 when the sleeve 20 is in the uphole closed position. In this manner, fluid in the sleeve bore 26 or housing bore 14 may be prevented from leaking out of the sleeve assembly 2 via the treatment ports 22 when the sleeve 20 is in the uphole closed position.

As shown in FIGS. 3 to 5B, in some embodiments, the housing 10 can further comprise an annular overhang 19 forming a protection pocket 24 for receiving a portion of the sleeve 20 containing the treatment ports 22 when the sleeve 20 is in the uphole closed position. In some embodiments, seals 27, 28 can be located in the protection pocket 24 to further protect the inset members 40 from contact with fluids, being washed out, or eroded when the sleeve 20 is in the uphole closed position, thereby protecting inset members 40 located in the treatment ports 22 as described in greater detail below. For example, the seals 27, 28 can be located in the outer and/or inner walls of the sleeve 20 and configured to be located within the protection pocket 24 when the sleeve 20 is in the uphole closed position. The seals 27,28 can also be located in the interior walls of the protection pocket 24, or both the sleeve 20 and the interior walls of the protection pocket 24.

With reference to FIG. 3, the sleeve 20 further comprises a seat 30 configured to interact with an actuating member 50. The seat 30 is configured to engage and restrict movement of the actuating member 50 thereby. In the depicted embodiment, the seat 30 is located downhole of the treatment ports 22. In some embodiments, the actuating member 50 is a ball, a plug or a dart configured to be temporarily retained by the seat 30 during which time it substantially obstructs fluid flow through the sleeve bore 26. An example of a suitable actuating member 50 is the actuating device disclosed in Applicant's PCT patent application no. PCT/CA2019/051054, incorporated herein in its entirety.

Referring still to FIG. 3, the sleeve assembly 2 is shown with the sleeve 20 at the uphole closed position, wherein the one or more treatment ports 22 of the sleeve 20 are not aligned with the one or more flow ports 12 of the housing 10. In the uphole closed position, the one or more flow ports 12 are blocked by the body of the sleeve 20, obstructing fluid communication between the sleeve bore 26 and the formation. When an actuating member 50 corresponding to the sleeve assembly 2 is introduced into the casing bore from surface, fluid pressure and/or gravity pushes it through the casing bore until it engages with the seat 30, thereby obstructing fluid flow through sleeve bore 26. At this point, fluid pressure can be adjusted to a threshold level to actuate the sleeve 20 toward the downhole open position. Referring to FIG. 4, in the downhole open position, the one or more treatment ports 22 of the sleeve 20 are at least partially aligned with the corresponding one or more flow ports 12 of the housing 10, allowing fluid communication between the sleeve bore 26 and the formation.

Referring to FIGS. 3, 4, 7 and 8, in an embodiment, the seat 30 comprises a plurality of seat retaining members 32 disposed in corresponding seat slots 34 in the sleeve 20. In an embodiment, the housing bore 14 further comprises an annular groove 16 located downhole of the seat 30 when the sleeve 20 is in the uphole closed position, and axially aligned with the seat 30 when the sleeve 20 is in the downhole open position. In such embodiments, the seat retaining members 32 have a radial thickness greater than a thickness of the sleeve 20. In the uphole closed position, the portion of the seat retaining members 32 distal the center of the sleeve bore 26 engages the interior walls of the housing bore 14, resulting in a portion of the seat retaining members 32 protruding into the sleeve bore 26. The corresponding actuating member 50 is configured to pass through sleeve bore 26 and engage with the protruding seat retaining members 32 when the sleeve is in the uphole closed position. With the actuating member 50 engaged with the seat 30, fluid flow is obstructed through sleeve bore 26. With fluid flow obstructed, fluid pressure can be increased to provide a downhole force on the sleeve 20 effected through the actuating member 50 and the seat 30. Once a specified pressure threshold is reached, the sleeve 20 is shifted from the uphole closed position to the downhole open position.

Figure 7:
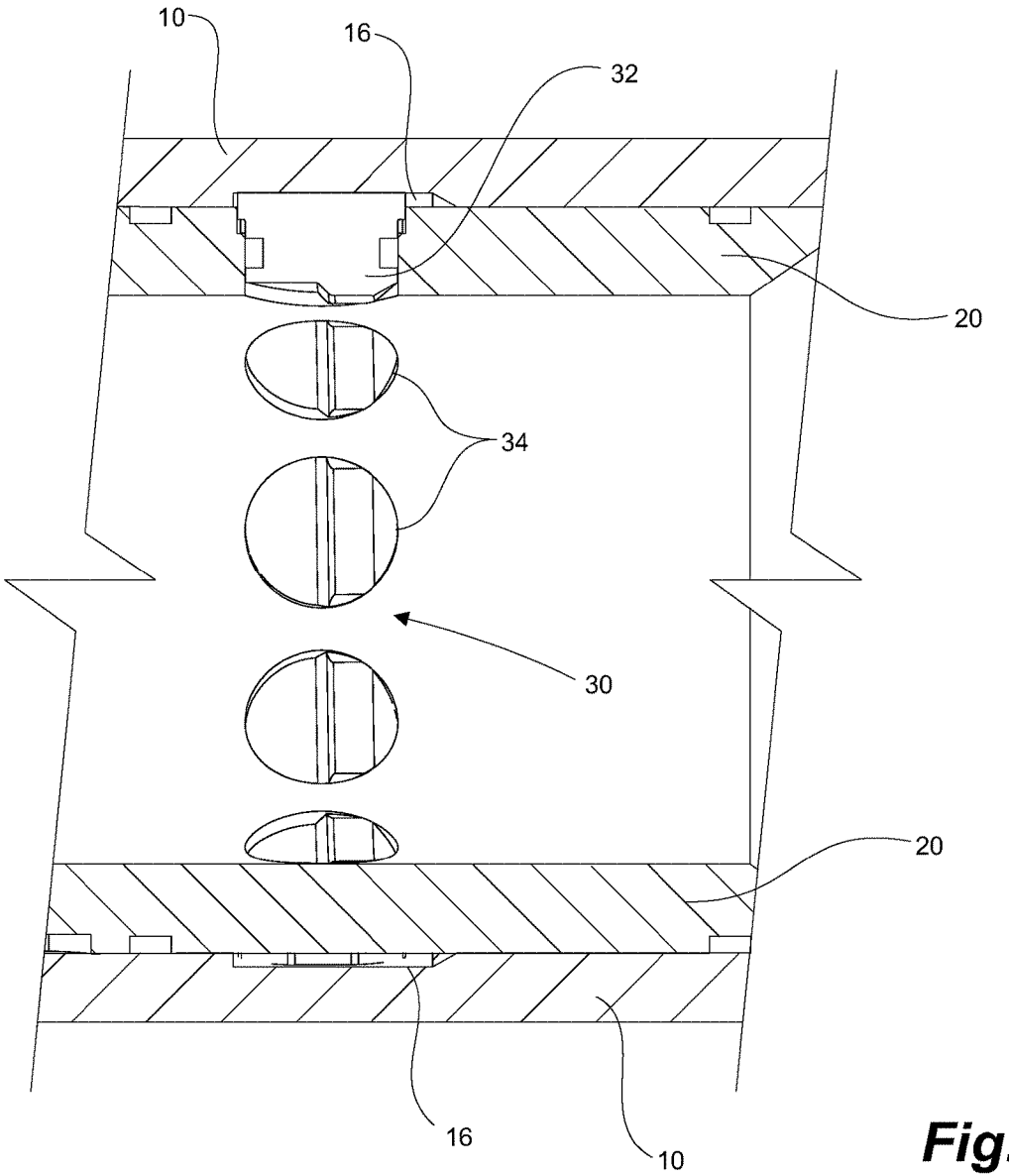
FIG. 7 is a detailed side section view of a seat of the sleeve assembly of FIG. 4.
Figure 8:
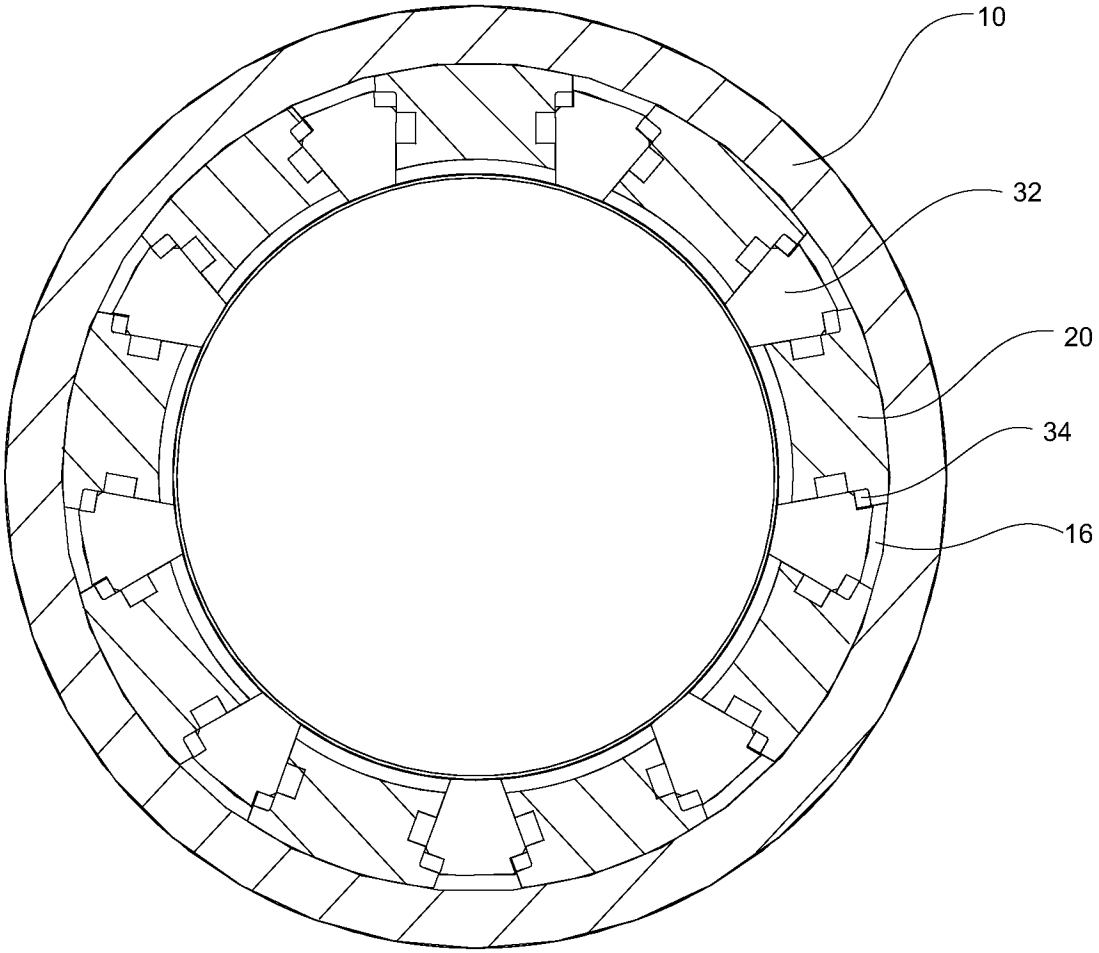
FIG. 8 is a cross section view of the sleeve assembly at line B-B as shown in FIG. 4.

The movement of the sleeve 20 can be limited at an uphole end of the housing bore 14 by an uphole shoulder 17 and at the downhole end of the housing bore 14 by a downhole shoulder or ramp 18. As shown in FIGS. 7 and 8, when the sleeve 20 is in the downhole open position, the seat slots 34 align with the annular groove 16, resulting in the seat retaining members 32 radially retracting from the sleeve bore 26 into the annular groove 16 such that they clear the sleeve bore 26, and allowing the actuating member 50 to pass through the now-unobstructed sleeve bore 26 and the housing bore 14 downhole to a subsequent sleeve assembly 2.

In alternative embodiments, another type of deformable seat 30 may be used which retains the actuating member 50 thereon when the sleeve 20 in the uphole closed position, and permits the actuating member 50 to proceed downhole thereby when the sleeve 20 is in the downhole open position.

In other embodiments, the seat 30 can simply be an annular constriction in the sleeve bore 26 configured to engage a corresponding actuator 50. The annular constriction cannot radially retract, such that the actuator 50 is permanently seated on the seat 30 once engaged therewith, and is removable via methods such as milling out, reverse circulation, or dissolving.

In some embodiments, a series or cluster of sleeve assemblies 2 can be configured to be actuated by a single actuator 50 by configuring the seats 30 thereof to be retractable or deformable, as described above, and to have the same dimensions corresponding with said actuator 50. In this configuration, the actuator 50 can engage a most uphole assembly 2 of the cluster to actuate it to the open position upon application of sufficient bore pressure, then proceed further downhole to the next assembly 2 of the cluster after the seat 30 of the most uphole assembly 2 is retracted or deformed. A most downhole assembly 2 of the cluster can have a non-retracting/deformable seat 30, such that the actuator 50 is not permitted to proceed further downhole after engaging therewith.

Figure 9:
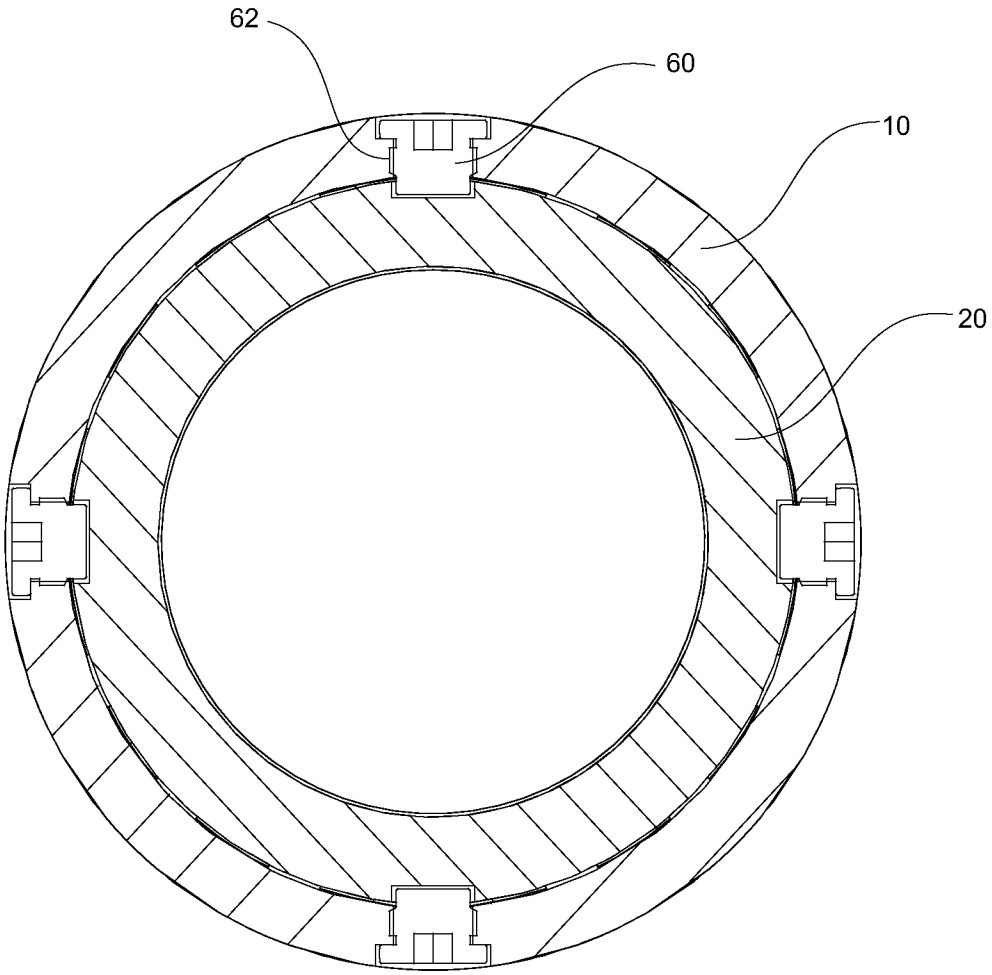
FIG. 9 is a cross section view of the sleeve assembly at line C-C as shown in FIG. 4.

Referring to FIGS. 3, 4 and 9, in an embodiment, the sleeve 20 is held in the uphole closed position using a retainer 60. In some embodiments, the retainer 60 is a shear screw, a shear pin or a detent member such as a collet engaging a slot or groove. The retainer 60 can be configured to require a requisite shifting force to overcome said retainer 60 and shift the sleeve 20.

Once in the sleeve 20 is in the downhole open position, friction and the direction of fluid flow will generally keep the sleeve 20 in the downhole open position. However, a downhole retainer 62 such as a second detent member can be used to retain the sleeve in the downhole open position. The second detent member can also be provided at other locations where the sleeve 20 and housing 10 contact in the downhole open position to retain the sleeve 20 in the open position.

Referring to FIGS. 3 to 6, in some embodiments, an inset member 40 is disposed in each of the one or more treatment ports 22. In some embodiments, the one or more inset members 40 temporarily obstruct fluid flow through the one or more flow ports 22. When the sleeve 20 is in the uphole closed position, the inset members 40 are protected from fluid flow in the wellbore and exterior of the sleeve assembly 2, which protects the inset members 40 when the sleeve assembly 2 is run-in-hole and keeps the inset member 40 in place as fluid pressure builds up. When the sleeve 20 is moved to the downhole open position, the treatment ports 22 align with the flow ports 12. When the seat 30 of the sleeve assembly 2 is engaged with the actuating member 50, the sleeve bore 26 is blocked and the pressure differential between the fluid in the sleeve bore 26 and the formation is exerted on the inset members 40. In an embodiment, the inset members 40 are designed to temporarily maintain fluid pressure in the sleeve bore and to shatter, rupture, or otherwise be removed from the treatment ports 22 at a threshold pressure. The specific threshold pressure depends on the specific characteristics of the inset members 40 and how they are secured in the treatment ports 22, which can be selected to provide the desired threshold pressure.

In an embodiment, the inset member 40 is a burst disc comprised of a suitable material such as a frangible material. Examples of such materials include an alloy, ceramic, or glass. The inset member 40 is secured in the treatment port 22 and is designed to rupture, shatter, or otherwise clear the treatment port 22 in response to the casing bore reaching the threshold pressure. In some embodiments, the threshold pressure is between 500 to 2,500 pounds per square inch.

Figure 5A:
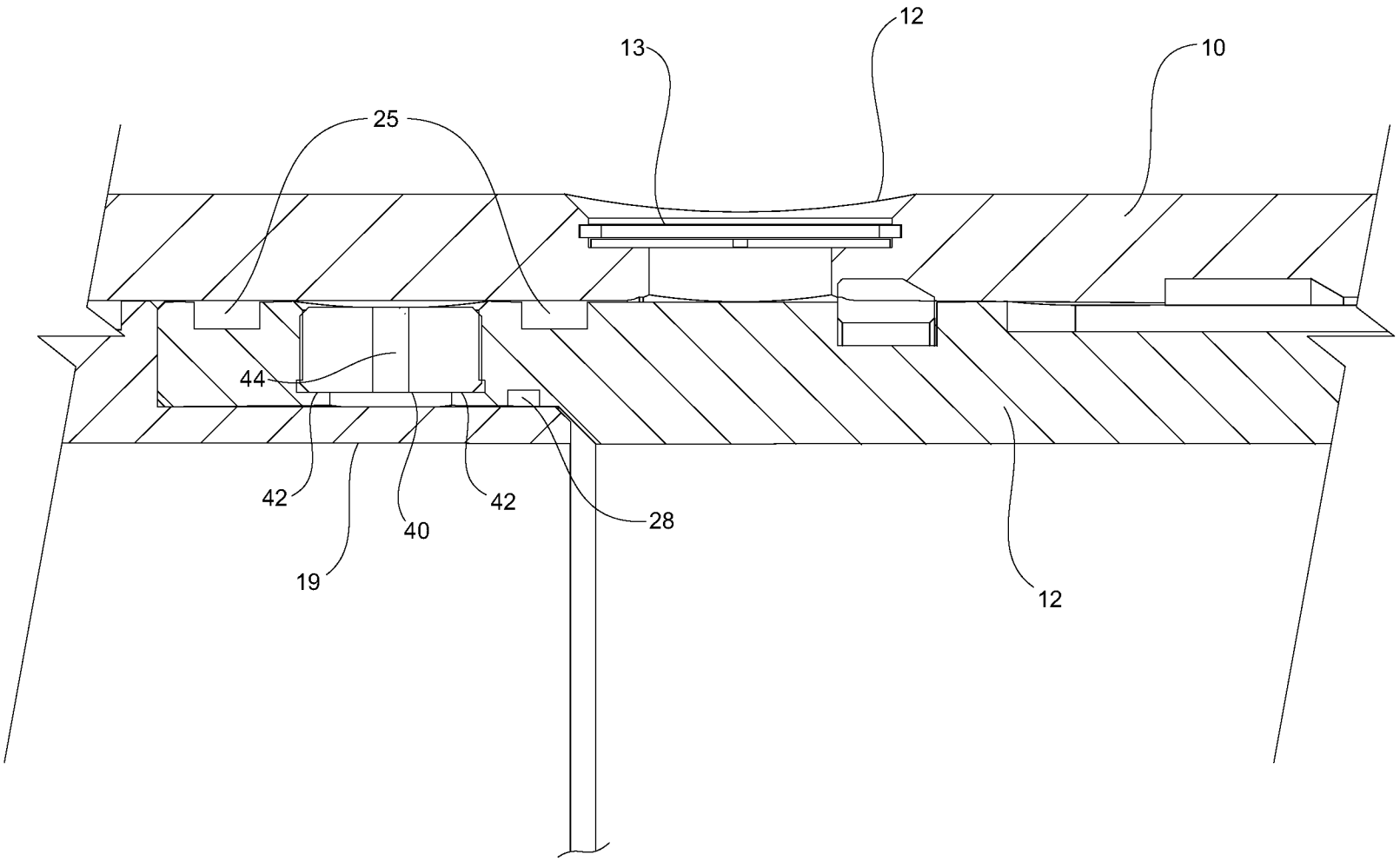
FIG. 5A is a detailed side section view of a flow port and a treatment port of the sleeve assembly of FIG. 3.
Figure 5B:
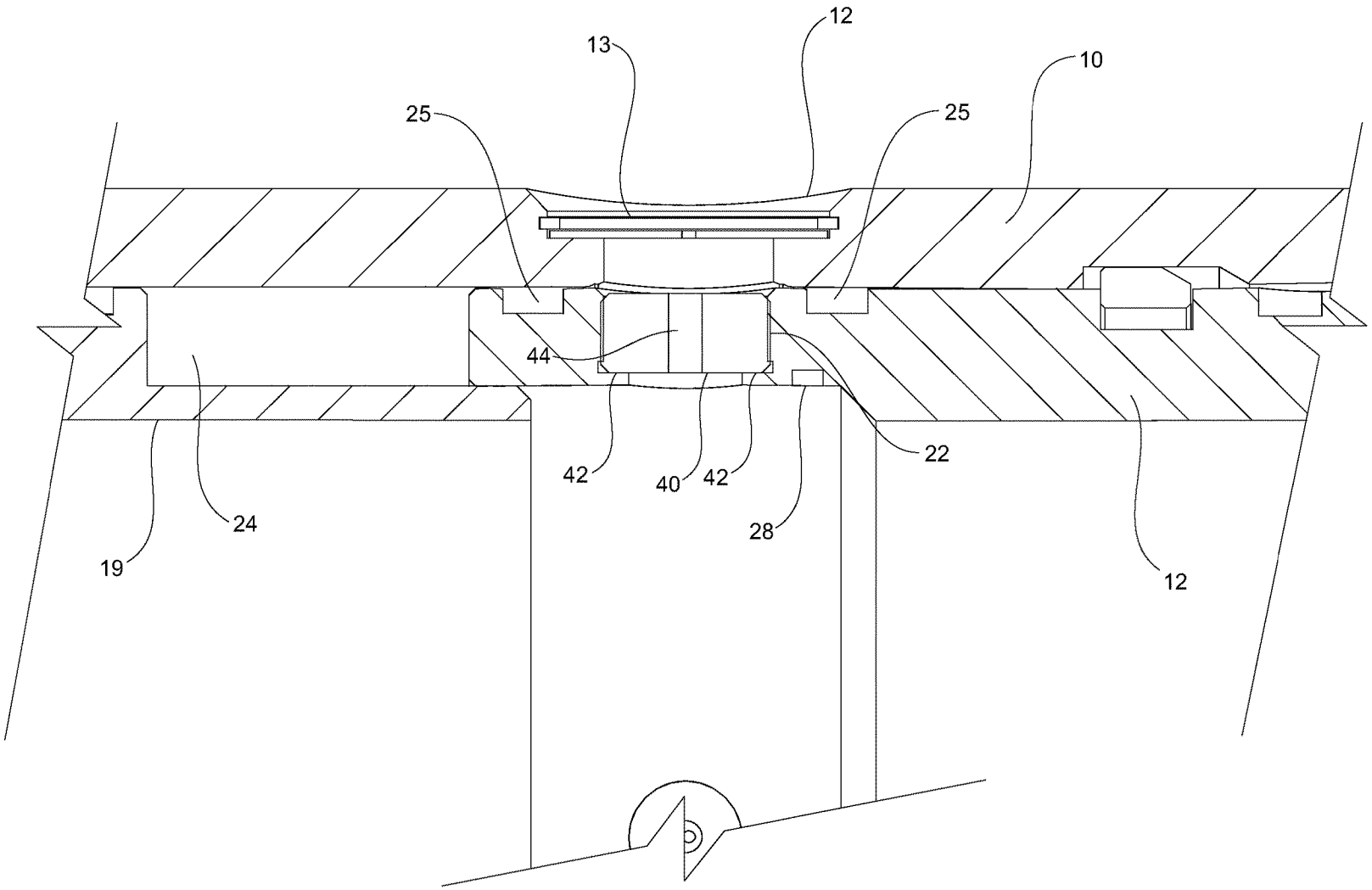
FIG. 5B is a detailed side section view of a flow port and a treatment port of the sleeve assembly of FIG. 4.
Figure 6:
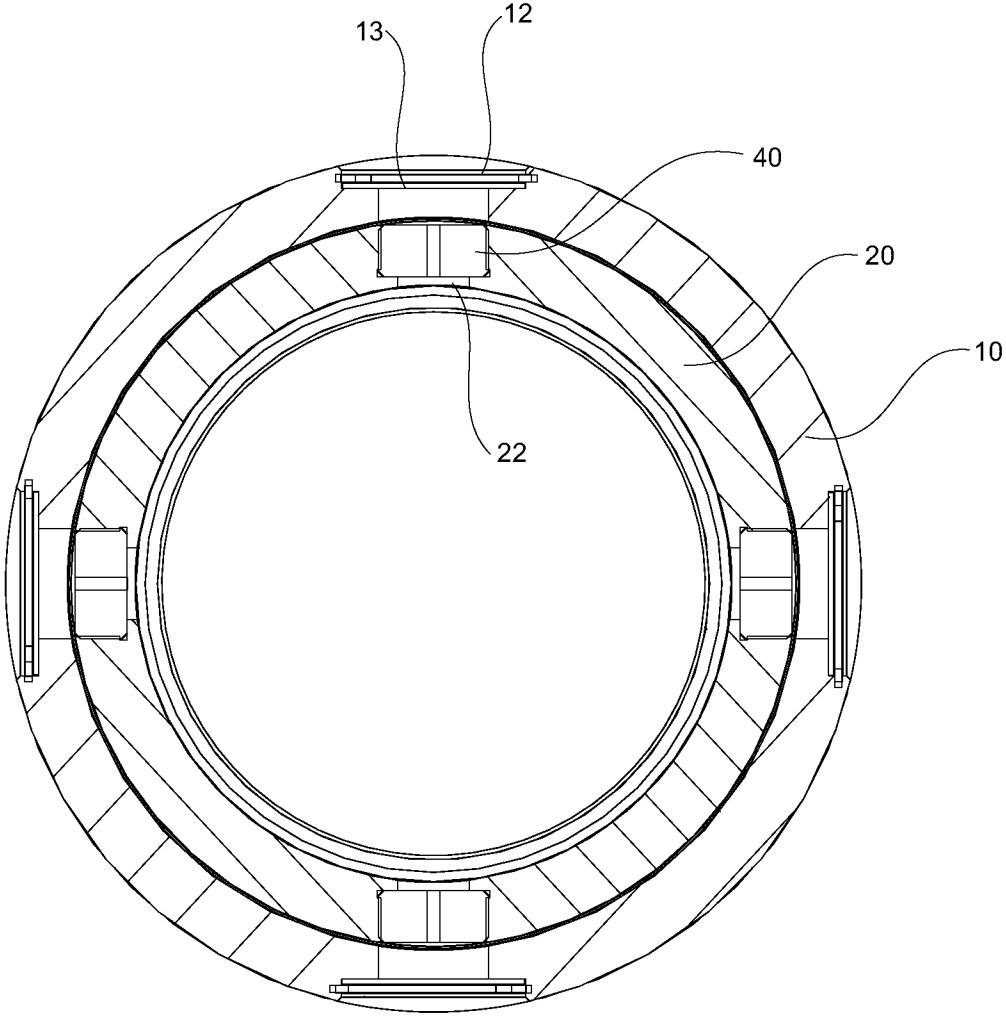
FIG. 6 is a cross section view of the sleeve assembly at line A-A as shown in FIG. 4.

In embodiments where the inset member 40 is a burst disc, to prevent burst discs from prematurely bursting when downhole zones are treated, burst discs may either comprise small pressure equalizing holes or are protected from fluid pressure by the housing 10. Referring to FIG. 5A, in embodiments wherein the housing 10 comprises an annular overhang 19 defining a protection pocket 24, the inset members 40 may be protected from fluid flow from the housing bore 14 when the sleeve 20 is in the uphole closed position, thus preventing the burst discs 40 from being prematurely ruptured by fluid pressure in the casing bore prior to the sleeve 20 being actuated to the downhole open position. In some embodiments, annular seals can be provided in seal grooves defined on the annular overhang 19 or sleeve 20 to further fluidly seal inset members 40 in the uphole closed position.

In some embodiments, the inset member 40 is threaded and is matingly screwed into threading of the treatment ports 22. In other embodiments, the inset member 40 is secured in the treatment ports 22 via other means such as welding or using an adhesive. In an embodiment, the threaded inset member 40 is comprised of a non-dissolvable material, such as carbide or a ceramic, and forming a nozzle 44.

In some embodiments, the threaded inset member 40 is comprised of a dissolvable material designed to stay intact at a specified pressure range but will dissolve over time when exposed to fluid. Such an embodiment would allow the opening of the treatment port to increase in cross-sectional size over time, which is suitable for applications where a smaller opening is used during fracturing and a larger opening is used during production.

In an embodiment, the threaded inset member 40 is comprised of a non-dissolvable material forming a nozzle 44, such as carbide or a ceramic, surrounded by a dissolvable material 42, such as magnesium-based or aluminum-based materials. While carbide, ceramic, magnesium-based and aluminum-based materials have been identified as suitable materials, other suitable materials could be used. This embodiment allows a treatment zone to be treated at a lower flow rate during fracturing than the desired flow rate during production, which is suitable for limited/multiple entry injection, wherein a target treatment zone comprises a cluster of sleeve assemblies 2. During limited/multiple entry injection operations, a single actuator 50 is used to open a cluster of sleeve assemblies 2 from uphole closed positions to downhole open positions. Once the cluster of sleeve assemblies 2 are opened, the entire target treatment zone is injected with fracturing fluid. The use of nozzles 44 in limited/multiple entry ensures that fluid flows through all of the sleeve assemblies 2 of the cluster and all areas of the target zone are treated. After fracturing is complete, the nozzles 44 fall out of the treatment ports 22 and through the flow ports 12 once the dissolvable material 42 is dissolved. The treatment ports 22 then have a larger opening, which is suitable for production. In some embodiments, the opening of the nozzle 44 is 0.35" and the opening of the treatment port 22 once the dissolvable material has dissolved is 0.625".

In this embodiment, when the inset member 40 becomes exposed to water or fluid from the wellbore, the dissolvable material 42 begins to dissolve but will maintain integrity for a designed period of time. For example, up to 20 hours. During this time, a limited amount of fluid flow occurs through the nozzle 44, which can be selected to suit the particular application. In fracturing operations, this would correspond to the desired fluid flow during fracturing of the formation. Once the dissolvable material 42 dissolves, the non-dissolvable nozzle 44 is no longer secured in the treatment port 22 and is removed from the treatment port 22 and the flow port 12, allowing increased fluid flow through the entire cross section of the opening of the treatment port 22 and the flow port 12.

As the inset member 40 of the sleeve assembly 2 disclosed herein may be located in the treatment ports 22 and may be protected from the wellbore when the sleeve 20 is in the uphole closed position, the inset members 40 may be protected from contact with wellbore fluids in the closed position and thus premature dissolution of the dissolvable material 42 may be avoided. Further, to prevent contact of the inset member 40 with fluid in the sleeve bore 26 and premature dissolution of the dissolvable material 42, the treatment port 22 may further comprise a protective layer 13 located between the inset member 40 and sleeve bore 26. Such a protective layer can comprise a gel to prevent contact between fluid in the sleeve bore 26 and the inset member 40, and a membrane to retain the gel in the treatment port 22. The gel can be any suitable material, such as a cement-inhibiting grease. The membrane can also be any suitable material for retaining the gel in the treatment port 22, such as a thin sheet of aluminum. Additionally, with reference to FIGS. 3 to 5B, in embodiments wherein the housing comprises an annular overhang 19 defining a protection pocket 24 configured to receive the sleeve 20 and protect the treatment ports 22 when the sleeve 20 is in the uphole closed position, the inset members 40 may be protected from fluids in the casing bore or wellbore when the sleeve 20 is in the closed position.

In an embodiment, the treatments ports 12 of the housing 10 also comprise an outer protective layer 13, which is comprised of a gel held in place with a membrane.

Figure 10:
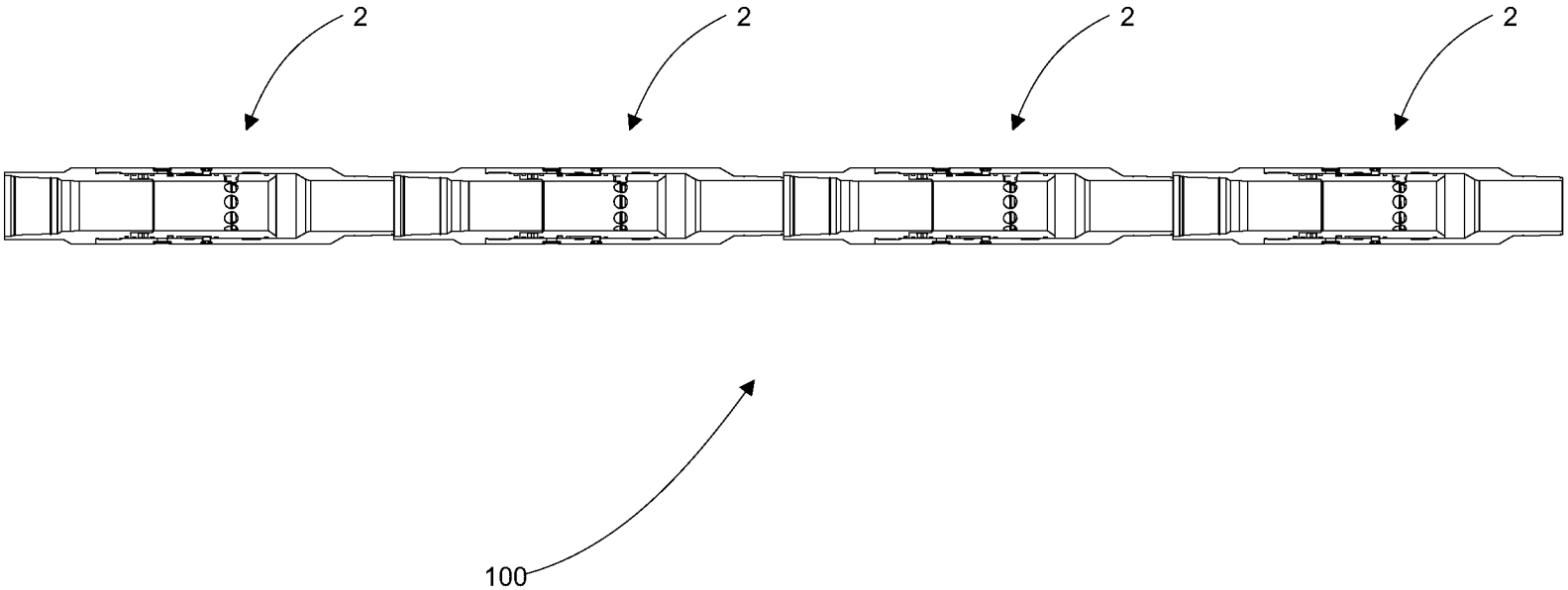
FIG. 10 is a string of sleeve assemblies.

Referring to FIG. 10, the sleeve assemblies 2 can be located at intervals along a casing string 100. In some embodiments, the sleeve assemblies 2 are initially set to a closed position. Actuating members 50 can be introduced to engage corresponding target sleeve assemblies 2 and open the sleeves 20 thereof to treat a targeted treatment zone. The actuating members 50 introduced can have increasingly larger diameters to engage corresponding seats 30 in sleeve assemblies 2 from the most downhole sleeve assembly 2, or cluster of assemblies 2, first and working uphole.

In an embodiment, a method of treating a zone of a formation using the sleeve assembly 2 comprises dropping an actuating member 50 down the casing string to engage the seat 30 of the sleeve assembly 2 corresponding to a target zone. Pressure within the casing string can be increased to shift the sleeve 20 from the uphole closed condition to the downhole open condition, thereby aligning the treatment ports 22 and flow ports 12, and exposing the inset members 40 in the treatment ports 22. In some embodiments, exposing the inset members 40 includes moving them out of a protection pocket 24. Fluid pressure in the casing bore can then be further elevated to a threshold pressure to remove inset members 40, which permits fluid to flow through the treatment ports 22 and flow ports 12 and allows treatment of the formation.

Where it is desired to open a cluster of sleeve assemblies 2 corresponding to the target zone, an actuating member 50 corresponding to the seats 30 of the target cluster of sleeve assemblies 2 can be introduced into the casing bore. When the actuating member 50 engages the seat 30 of a furthest uphole assembly 2 of the cluster, the pressure within the casing string can be increased to shift the sleeve 20 of the sleeve assembly 2 to the downhole open position. The seat retaining members 32 of the sleeve 20 then radially retract into the annular groove 16 of the sleeve housing 10 to permit the actuating member 50 to proceed downhole to the next sleeve assembly 2 of the cluster. The sleeve assemblies 2 of the cluster can be opened in the same manner as above until the actuating member 50 reaches a most downhole sleeve assembly 2 of the cluster, which does not possess radially retracting seat retaining members 32 and instead permanently retains the actuating member 50 on the seat 30 thereof until the actuating member 50 is removed via milling, reverse circulation, or dissolving. Once all of the sleeve assemblies 2 of the cluster have been opened, fluid pressure in the casing bore can then be further elevated to the threshold pressure to remove the inset members 40, which permits fluid to flow through the sleeves ports 22 and flow ports and allows treatment of the formation through all of the sleeve assemblies 2 of the cluster. In such embodiments, the casing bore pressure required to shift the sleeves 20 is selected to be lower than the threshold pressure to remove the inset members 40, such that the inset members are not inadvertently removed prior to the entire cluster of sleeve assemblies 2 being actuated to the open position.

In another embodiment, a method of limited entry injection treatment of a target zone of a formation using a cluster of sleeve assemblies 2 comprises introducing an actuating member 50 to open a cluster of sleeve assemblies corresponding to a target zone, as above. As above, the cluster of sleeves assemblies 2 are opened, wherein the sleeves assemblies 2 are all shifted from an uphole closed position to a downhole open position, thereby aligning the treatment ports 22 and flow ports 12, and exposing the inset members 40 in the treatment ports 22. In some embodiments, exposing the inset members 40 includes moving them out of a protection pocket 24. In this embodiment, the inset members 40 comprise nozzles 44, encased in dissolvable material 42, to allow fluid communication from the casing string bore to the target zone in the formation. After the dissolvable material 42 is exposed to water or fluid for a specified period of time, such as during fracturing/treatment operations, the dissolvable material 42 dissolves and the nozzles 44 are released from the flow ports 22, providing increased fluid flow to the target zone during wellbore production.

Figure 11A:
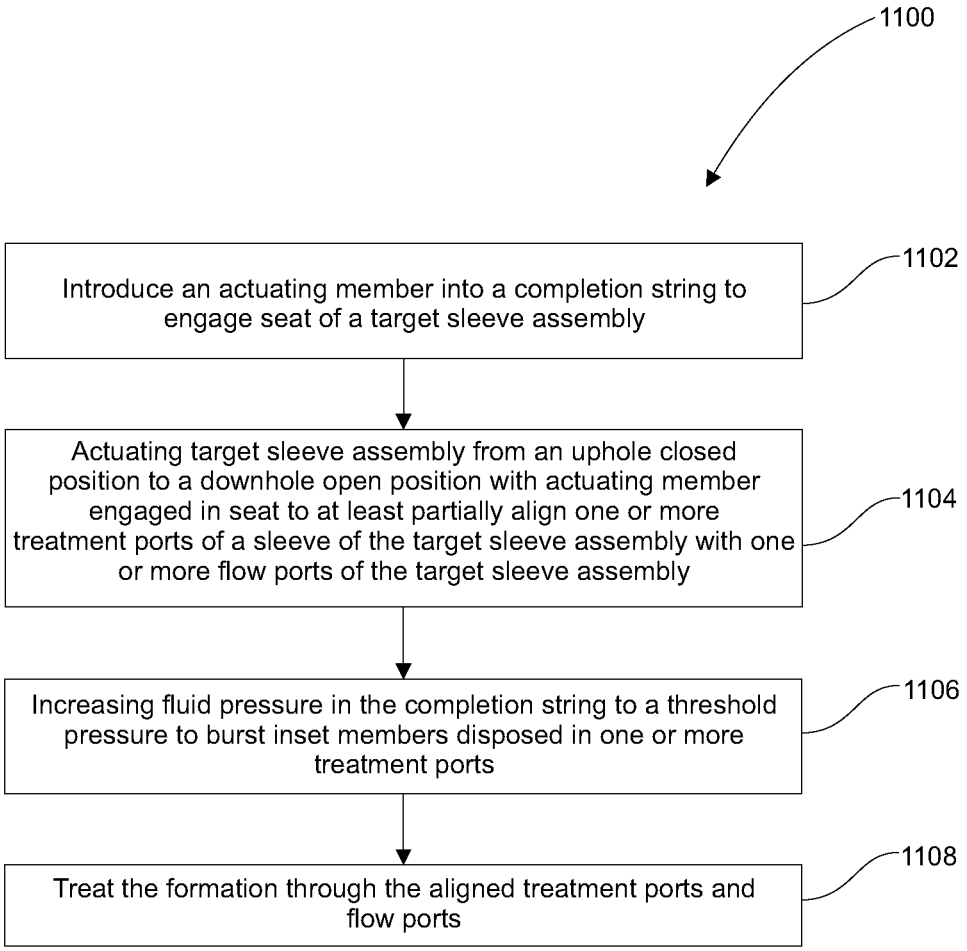
FIGS. 11A and 11B are flowcharts illustrating methods of treating a zone in a formation.

Referring to FIG. 11A, in an embodiment, a method of treating a zone in a formation accessed with a completion string having one or more sleeve assembly therealong 1100 comprises, at block 1102, introducing an actuating member into the completion string to engage a seat of a target sleeve assembly of the one or more sleeve assemblies. At block 1104, the target sleeve assembly is actuated from an uphole closed position to a downhole open position with the actuating member engaged in the seat to at least partially align one or more treatment ports of a sleeve of the target sleeve assembly with one or more flow ports of the target sleeve assembly. At block 1106, fluid pressure is increased in the completion string to a threshold pressure to burst inset members disposed in the one or more treatment ports. At block 1108, the formation is treated through the aligned treatment ports and flow ports.

Figure 11B:
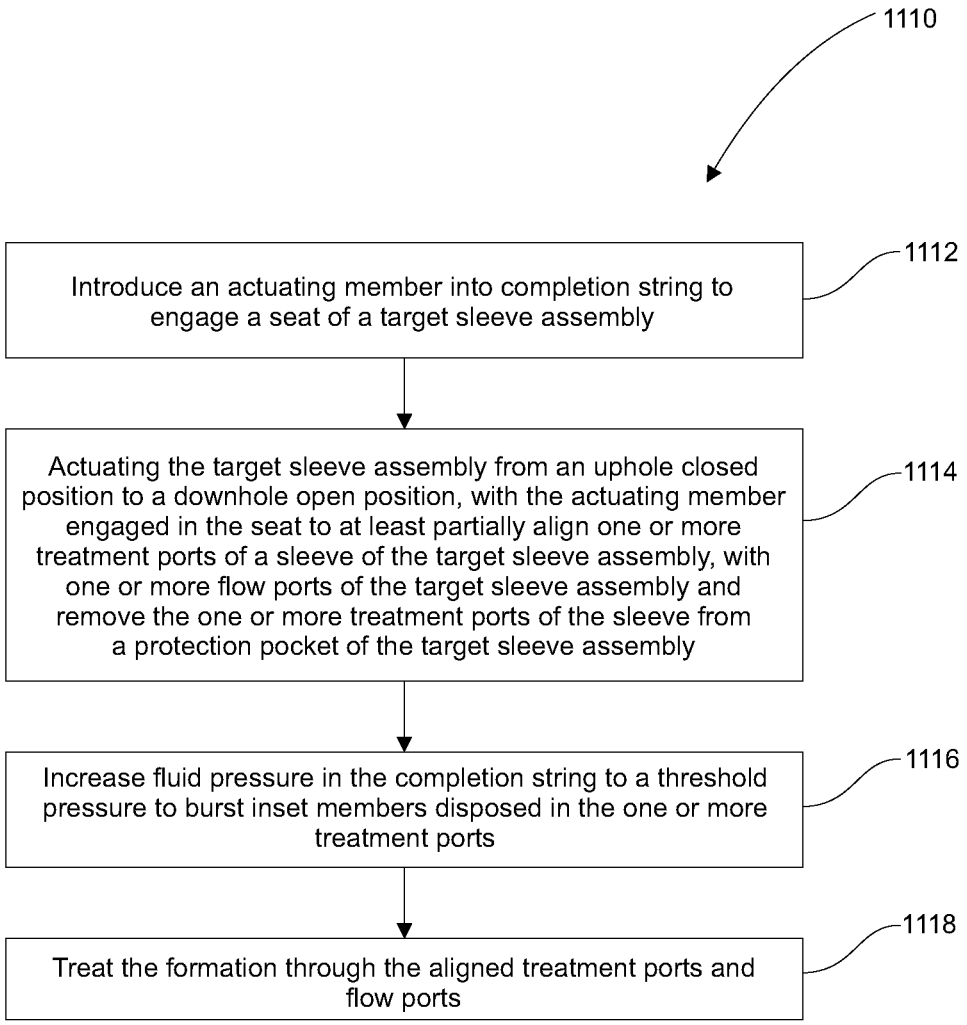

Referring to FIG. 11B, in an embodiment, a method of treating a zone in a formation accessed with a completion string having one or more sleeve assembly therealong 1110 comprising, at block 1112, introducing an actuating member into the completion string to engage a seat of a target sleeve assembly of the one or more sleeve assemblies. At block 1114, the target sleeve assembly is actuated from an uphole closed position to a downhole open position with the actuating member engaged in the seat to at least partially align one or more treatment ports of a sleeve of the target sleeve assembly with one or more flow ports of the target sleeve assembly and removing the one or more treatment ports of the sleeve from a protection pocket of the target sleeve assembly. At block 1116, fluid pressure is increased in the completion string to a threshold pressure to burst inset members disposed in the one or more treatment ports. At block 1118, the formation is treated through the aligned treatment ports and flow ports.

Figure 12A:
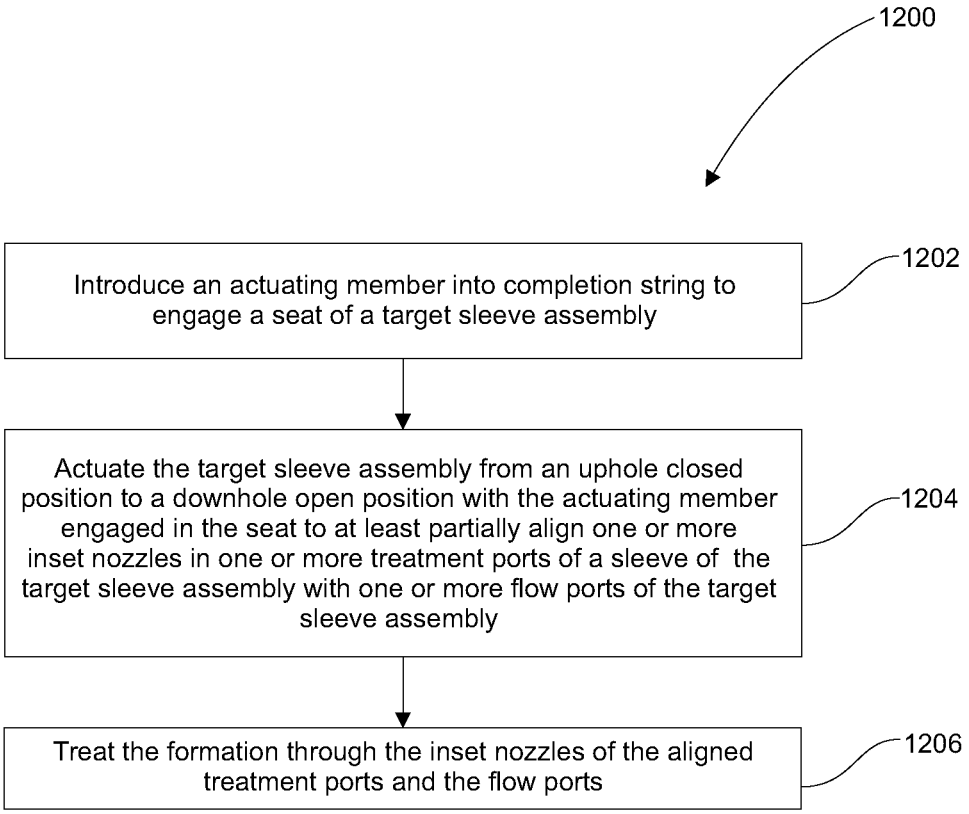
FIGS. 12A to 12C are flowcharts illustrating methods of treating a zone in a formation.

Referring to FIG. 12A, in an embodiment, a method of treating a zone in a formation accessed with a completion string having one or more sleeve assemblies therealong 1200 comprises, at block 1202, introducing an actuating member into the completion string to engage a seat of a target sleeve assembly of the one or more sleeve assemblies. At block 1204, the target sleeve assembly is actuated from an uphole closed position to a downhole open position with the actuating member engaged in the seat to at least partially align one or more inset nozzles in one or more treatment ports of a sleeve of the target sleeve assembly with one or more flow ports of the target sleeve assembly. At block 1206, the formation is treated through the inset nozzles of the aligned treatment ports and the flow ports.

Figure 12B:
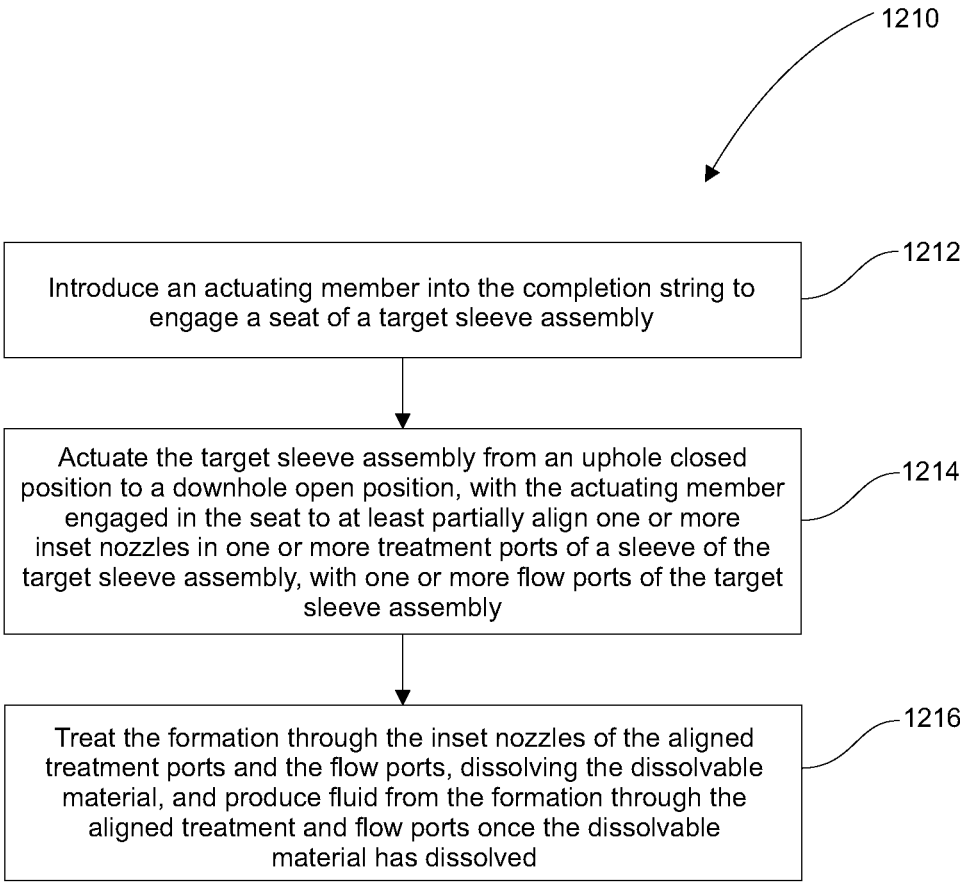

Referring to FIG. 12B, in an embodiment, a method of treating a zone in a formation accessed with a completion string having one or more sleeve assemblies therealong, wherein the inset nozzles are comprised at least partially of dissolvable material 1210 comprises, at block 1212, introducing an actuating member into the completion string to engage a seat of a target sleeve assembly of the one or more sleeve assemblies. At block 1214, the target sleeve assembly is actuated from an uphole closed position to a downhole open position with the actuating member engaged in the seat to at least partially align one or more inset nozzles in one or more treatment ports of a sleeve of the target sleeve assembly with one or more flow ports of the target sleeve assembly. At block 1216, the formation is treated through the inset nozzles of the aligned treatment ports and the flow ports, dissolving the dissolvable material, and producing fluid from the formation through the aligned treatment and flow ports once the dissolvable material has dissolved.

Figure 12C:
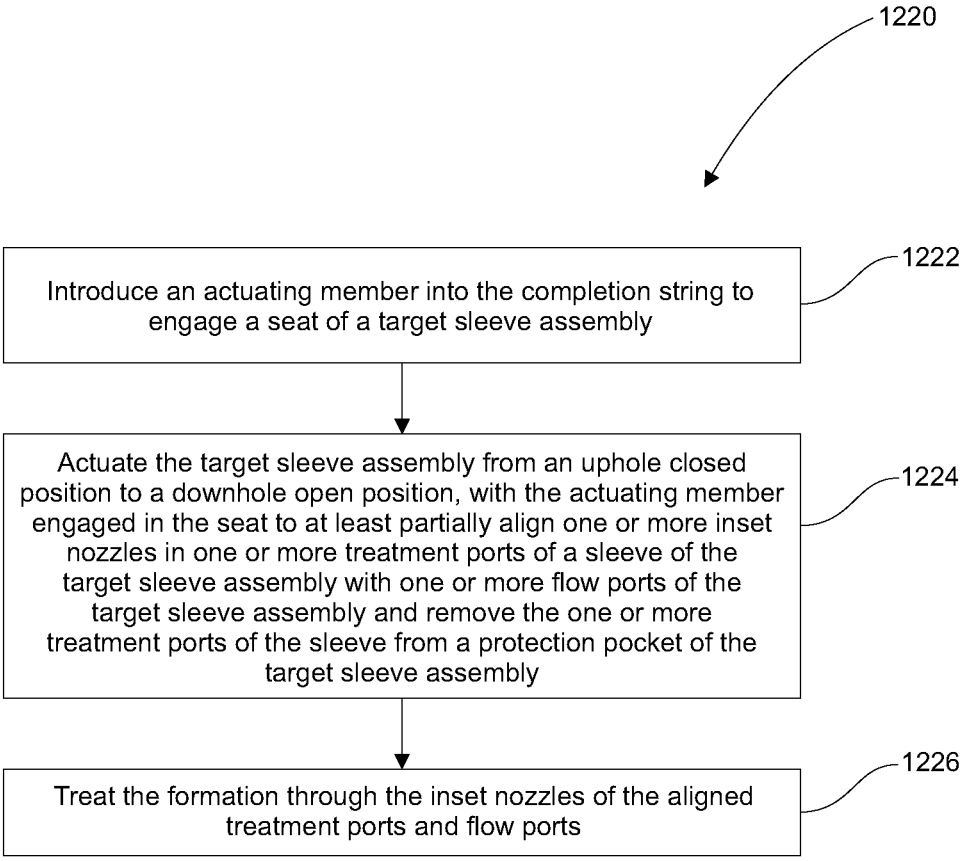

Referring to FIG. 12C, in an embodiment, a method of treating a zone in a formation accessed with a completion string having one or more sleeve assemblies therealong 1220 comprises, at block 1222, introducing an actuating member into the completion string to engage a seat of a target sleeve assembly of the one or more sleeve assemblies. At block 1224, the target sleeve assembly is actuated from an uphole closed position to a downhole open position with the actuating member engaged in the seat to at least partially align one or more inset nozzles in one or more treatment ports of a sleeve of the target sleeve assembly with one or more flow ports of the target sleeve assembly and removing the one or more treatment ports of the sleeve from a protection pocket of the target sleeve assembly. At block 1226, the formation is treated through the inset nozzles of the aligned treatment ports and the flow ports.

Although a few embodiments have been shown and described, it will be appreciated by those skilled in the art that various changes and modifications can be made to those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof.

We claim:

1. A sleeve assembly for controlling communication with a downhole formation comprising:

a sleeve housing having a housing bore and one or more flow ports;

a sleeve retained slidably in the housing bore and having a sleeve bore and one or more treatment ports, the sleeve being slidable from an uphole closed position, in which the one or more flow ports are blocked by the sleeve, to a downhole open position in which the one or more flow ports are at least partially aligned with the one or more treatment ports;

a seat disposed in the sleeve bore, configured to extend at least partially into the sleeve bore to receive an actuating member; and one or more inset members disposed in each of the one or more treatment ports, wherein the one or more inset members comprise one or more nozzles.

2. The sleeve assembly of claim 1, wherein the one or more nozzles comprise at least partially dissolvable material.

3. The sleeve assembly of claim 1, wherein the one or more nozzles are non-dissolvable.

4. The sleeve assembly of claim 3 wherein the one or more inset members comprise a dissolvable material surrounding the non-dissolvable nozzle, wherein the inset member is removable from the treatment port when the dissolvable material dissolves.

5. The sleeve assembly of claim 1, wherein the sleeve defines one or more radial grooves in an exterior surface of the sleeve straddling the one or more treatment ports and comprising sealing members positioned therein.

6. The sleeve assembly of claim 1, wherein the housing defines one or more radial grooves in the housing bore straddling the one or more flow ports and comprising sealing members positioned therein.

7. The sleeve assembly of claim 1, wherein the seat is actuable between a first condition wherein the seat retains an actuating member and a second condition wherein the seat is adapted to deform to allow the actuating member to pass through the sleeve bore.

8. The sleeve assembly of claim 7, wherein the seat is in the first condition when the sleeve is in the uphole closed position and in the second condition when the sleeve is in the downhole open position.

9. The sleeve assembly of claim 1, wherein the actuating member is one of a ball, a plug, or a dart.

10. The sleeve assembly of claim 1, wherein the sleeve is temporarily retained in the uphole closed position using a retainer.

11. The sleeve assembly of claim 10, wherein the retainer is a shear screw or retaining pin.

12. The sleeve assembly of claim 1, wherein the sleeve housing comprises an annular overhang defining an annular protection pocket configured to receive at least a portion of the sleeve when the sleeve is in the uphole closed position, such that the one or more inset members are located in the protection pocket.

13. The sleeve assembly of claim 12, further comprising sealing members positioned on one or both of the sleeve and sleeve housing to fluidly isolate the one or more inset members in the protection pocket when the sleeve is in the uphole closed position.

14. The sleeve assembly of claim 1, wherein the one or more inset members further comprise one or more burst discs, the one or more burst discs comprising a frangible material for at least temporarily maintaining fluid pressure in the sleeve bore and configured to be removed once the fluid pressure reaches a threshold pressure.

15. A method of treating a zone in a formation accessed with a completion string having one or more sleeve assemblies therealong, comprising:

introducing an actuating member into the completion string to engage a seat of a target sleeve assembly of the one or more sleeve assemblies;

actuating the target sleeve assembly from an uphole closed position to a downhole open position with the actuating member engaged in the seat to at least partially align one or more treatment ports of a sleeve of the target sleeve assembly with one or more flow ports of the target sleeve assembly;

increasing fluid pressure in the completion string to a threshold pressure to burst one or more inset members disposed in the one or more treatment ports; and treating the formation through the aligned treatment ports and flow ports, wherein the step of actuating the target sleeve assembly to the downhole open position further comprises removing the one or more treatment ports of the sleeve from a protection pocket of the target sleeve assembly.

16. A method of treating a zone in a formation accessed with a completion string having one or more sleeve assemblies therealong, comprising:

introducing an actuating member into the completion string to engage a seat of a target sleeve assembly of the one or more sleeve assemblies;

actuating the target sleeve assembly from an uphole closed position to a downhole open position with the actuating member engaged in the seat to at least partially align one or more inset members in one or more treatment ports of a sleeve of the target sleeve assembly with one or more flow ports of the target sleeve assembly, the one or more inset members comprising one or more inset nozzles; and treating the formation through the one or more inset nozzles of the aligned treatment ports and the flow ports.

17. The method of claim 16, wherein the one or more inset nozzles comprise at least partially dissolvable material, and the step of treating the formation further comprises:

dissolving the dissolvable material; and producing fluid from the formation through the aligned treatment ports and flow ports once the dissolvable material has dissolved.

18. The method of claim 16, wherein the step of actuating the target sleeve assembly to the downhole open position further comprises removing the one or more treatment ports of the sleeve from a protection pocket of the target sleeve assembly.

19. The method of claim 16, wherein the one or more inset members further comprise one or more burst discs.

20. A sleeve assembly for controlling communication with a downhole formation comprising:

a sleeve housing having a housing bore and one or more flow ports;

a sleeve retained slidably in the housing bore and having a sleeve bore and one or more treatment ports, the sleeve being slidable from an uphole closed position, in which the one or more flow ports are blocked by the sleeve, to a downhole open position in which the one or more flow ports are at least partially aligned with the one or more treatment ports;

a seat disposed in the sleeve bore, configured to extend at least partially into the sleeve bore to receive an actuating member; and one or more inset members disposed in each of the one or more treatment ports, wherein the sleeve defines one or more radial grooves in an exterior surface of the sleeve straddling the one or more treatment ports and comprising sealing members positioned therein.

21. A sleeve assembly for controlling communication with a downhole formation comprising:

a sleeve housing having a housing bore and one or more flow ports;

a sleeve retained slidably in the housing bore and having a sleeve bore and one or more treatment ports, the sleeve being slidable from an uphole closed position, in which the one or more flow ports are blocked by the sleeve, to a downhole open position in which the one or more flow ports are at least partially aligned with the one or more treatment ports;

a seat disposed in the sleeve bore, configured to extend at least partially into the sleeve bore to receive an actuating member; and one or more inset members disposed in each of the one or more treatment ports, wherein the housing defines one or more radial grooves in the housing bore straddling the one or more flow ports and comprising sealing members positioned therein.

22. A sleeve assembly for controlling communication with a downhole formation comprising:

a sleeve housing having a housing bore and one or more flow ports;

a sleeve retained slidably in the housing bore and having a sleeve bore and one or more treatment ports, the sleeve being slidable from an uphole closed position, in which the one or more flow ports are blocked by the sleeve, to a downhole open position in which the one or more flow ports are at least partially aligned with the one or more treatment ports;

a seat disposed in the sleeve bore, configured to extend at least partially into the sleeve bore to receive an actuating member; and one or more inset members disposed in each of the one or more treatment ports, wherein the sleeve housing comprises an annular overhang defining an annular protection pocket configured to receive at least a portion of the sleeve when the sleeve is in the uphole closed position, such that the one or more inset members are located in the protection pocket.

* * * * *